US006414668B1

(12) United States Patent
Karube et al.

(10) Patent No.: US 6,414,668 B1
(45) **Date of Patent: *Jul. 2, 2002**

(54) LIQUID CRYSTAL DISPLAY DEVICE

(75) Inventors: Masao Karube, Fukaya; Kazuo Nakamura, Kitamoto; Masaki Miyatake, Fukaya; Hoko Hirai, Fukaya; Akihiko Saitoh, Fukaya; Yoshiro Aoki, Fukaya, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/234,511

(22) Filed: Jan. 21, 1999

(30) Foreign Application Priority Data

Jan. 21, 1998 (JP) ..... 10-009590
Dec. 10, 1998 (JP) ..... 10-351871

(51) Int. Cl.[7] ..... G09G 3/36

(52) U.S. Cl. ..... 345/98; 345/100; 345/103; 345/204; 345/87

(58) Field of Search ..... 345/96, 204, 209, 345/103, 98, 100, 95, 87, 92, 99

(56) References Cited

U.S. PATENT DOCUMENTS 3,922,668 A * 11/1975 Kishimoto et al. ..... 345/54
4,196,432 A * 4/1980 Chihara ..... 345/96
5,034,735 A * 7/1991 Inoue et al. ..... 345/96
5,191,455 A * 3/1993 Hashimoto et al. ..... 345/96
5,526,014 A * 6/1996 Shiba et al. ..... 345/96
5,648,792 A * 7/1997 Sato et al. ..... 345/100
6,049,321 A * 4/2000 Sasaki ..... 345/99
6,069,605 A * 5/2000 Ozawa ..... 345/98
6,072,456 A * 6/2000 Karube et al. ..... 345/98
6,265,889 B1 * 7/2001 Tomita et al. ..... 324/765

FOREIGN PATENT DOCUMENTS

JP 06308535 * 11/1994
JP 06-308535 11/1994
JP 07294870 * 11/1995
JP 07-294870 11/1995
JP 07-319428 12/1995
JP 07319428 * 12/1995
JP 11095252 * 4/1999

* cited by examiner

*Primary Examiner*—Richard Hjerpe
*Assistant Examiner*—Kevin N. Nguyen
(74) *Attorney, Agent, or Firm*—Pillsbury Winthrop LLP

(57) ABSTRACT

Arrangement of connection points of sampling switches to video bus lines within a signal line drive circuit 200 is improved such that connection points of video buses (SVn1 to SVn6) supplied with positive-polarity video signals relative to a predetermined reference potential and video buses (SVp1 to SVp6) supplied with negative-polarity video signals to analog switches (SWn11 to SWn22 and SWp11 to SWp22) make substantially symmetric patterns in the extending direction of the video buses. Since the sum of lengths of connection wirings belonging to a switch pair and their total resistance value becomes substantially equal in all switch pairs, the effective vales of shift amounts in signal line potentials are substantially flattened. Therefore, here is provided a drive circuit built-in liquid crystal display device realizing a good imaging quality removing noise such as stripe-shaped imaging defects which may occur when video signals are supplied to analog switches through a plurality of video buses.

20 Claims, 7 Drawing Sheets

LIQUID CRYSTAL DISPLAY DEVICE

BACKGROUND OF THE INVENTION

This invention relates to a liquid crystal display device and, more particularly, to a liquid crystal device of a drive circuit built-in type in which a display pixel portion and a drive circuit portion are incorporated integrally on a common substrate.

A drive circuit built-in liquid crystal display device integrally incorporating its drive circuit on a glass substrate is under progressive researches and developments toward its practical use because it leads to a reduction of components, simplifies the process for packaging the drive circuit onto the liquid crystal display panel, and hence contributes to a reduction of the cost.

A drive circuit built-in liquid crystal device is typically made, in case of TFT-LCD, by enclosing a liquid crystal between an array substrate having thin-film transistors as switching elements arranged in a matrix in accordance with pixels and an opposite substrate having formed color filters, providing polarization plates to these substrates, respectively, and mounting an illumination back light behind them. The matrix-arrayed substrate includes a display pixel portion made up of scanning lines and signal lines which are aligned in form of a matrix on the glass substrate and liquid crystal pixels formed on their crossing points via thin-film transistors as switching elements, and a peripheral drive circuit which is made simultaneously with the thin-film transistors in a common manufacturing process to surround the display pixel portion. The peripheral drive circuit includes a scanning line drive circuit for controlling switching actions of the thin-film transistors connected to pixels and a signal line drive circuit for supplying video signals to the thin-film transistors via the signal lines.

The signal line drive circuit includes a group of analog switches responsive to a timing signal for selectively connecting video signal lines to signal electrodes to supply video signals, and must operate in a higher frequency than the scanning line drive circuit. Moreover, along with progressively increasing demands for high fidelity, large capacity display, and so on, in high vision using an increased number of pixels, there have been remarked problems such as insufficient transmission bands of the video bus lines for transmitting video signals within the signal line drive circuit, and insufficient writing capacity of the analog switches for sampling the video signals on the video bus lines and supplying them to pixel switching elements.

To cope with the problems, a conventional technique divides the signal line drive circuit into a plurality of blocks and effects sampling of analog switches simultaneously within the blocks to lower the operation frequency. That is, by dividing the video bus lines into some blocks to introduce video signals in parallel and by having analog switches connected to each block of the video bus lines via a connection wiring to operate collectively for sampling, the operation frequency can be lowered by the number of blocks of the video bus so as to compensate the insufficient writing capacity of the analog switches.

However, when the conventional drive circuit built-in liquid is crystal display device is configured to supply video signals to a plurality of divisional blocks of the video signal lines as explained above, there arises the problem that stripe-shaped imaging defects 2 (stripe-shaped defects) extending longitudinally (in the column direction) appear on the display screen 1 as shown in FIG. 7, and degrade the imaging quality.

The Inventors made researches to locate its reason, and found a strong relation between the positions of the imaging defects on the screen and the positions of connection between analog switches and the video buses.

More specifically, immediately after sapling by an analog switch, electric charges stored in the analog switch flow in toward a video bus and the signal line connected to the analog switch. The flow of the electric charge causes the potential on the signal line to shift, and hence causes the signal written in a liquid crystal pixel to slightly shift from the video signal on the video bus.

In an analog switch connected to a video bus located far from the display pixel portion, the connection wiring between the analog switch and the video bus is longer and results in increasing the resistance of the connection wiring. As a result, electric charges accumulated in the analog switch during sampling is difficult to flow toward the video bus, and the ratio of the charges flowing toward the signal line increases.

In contrast, in an analog switch connected to a video bus near the display pixel portion, the connection wiring is shorter, the wiring resistance is lower, and the ratio of electric charge accumulated in the analog switch and flowing toward the signal line decreases.

This results in the phenomenon that shift amounts of video signals are small in signal lines connected to analog switches with shorter connection wirings to video buses whereas shift amounts of video signals are large in signal lines connected to analog switches with longer connection wirings. Therefore, effective voltage values applied to liquid crystal pixels vary with positions of signal lines, and cause them to vary in transmittance.

The Inventors found that, since the arrangement of connection points of analog switches and video buses was repeated for every block of sampling circuits, the difference in transmittance of the liquid crystal pixels was produced on the screen periodically along the row direction, and was noticeable as imaging defects appearing in the column direction.

FIG. 6 shows a wiring pattern in a signal line drive circuit by a conventional approach.

In FIG. 6, video signals SV1 to SV6 are applied to video buses 101 to 106 in this order. These video buses 101 through 106 and analog switches SW are connected in this order by connection wirings 211 to 216 via contact holes. As a result, adjacent signal electrodes are supplied with signals from adjacent video buses. Since lengths in of connection wirings are different only by the distance S between their video buses, difference in capacities caused by the wiring resistance and crossing of wirings is small, and no image noise occurs there.

However, in case of this example for comparison, there is a large difference in length of the connection wiring at the position where the shift register is switched from a certain stage to another. That is, the last wiring to the first stage (SR11) of the shift register and the first wring to the second stage (SR21) are different in length as large as 5 pitches, and the difference is as large as five times the difference in length between other adjacent wirings. Thus, the difference in wiring resistance is large and causes the difference in shift amount of video signal mentioned above.

Therefore, in the conventional device, the load to the wiring changes largely at the position where the shift register is switched from a stage to another, and image noise such as imaging defects cannot be prevented.

SUMMARY OF THE INVENTION

It is therefore an object of the invention to provide a liquid crystal display device of having a built-in drive circuit, which alleviates imaging defects caused by changes in length of wirings and improves the imaging quality.

According to the first aspect of the present invention, there is provided a liquid crystal display device having:

a display pixel portion including a plurality of liquid crystal pixel cells arranged in a matrix on an insulating substrate and a plurality of signal lines each connected commonly to said liquid crystal pixels in a column; and a signal line drive circuit including groups of positive-polarity video buses for transmitting positive-polarity video signals, groups of negative-polarity video buses disposed in parallel with said groups of the positive-polarity video buses to transmit negative-polarity video signals, and sampling circuit blocks made up of a plurality of positive-polarity switches connected individually to one of said positive-polarity video buses via connection wirings and a plurality of negative switches connected individually to one of said negative-polarity video buses via connection wirings so that both said switches align between said groups of the video buses and of the display pixel portion to make switch pairs each including one of said positive-polarity switches and one of said negative-polarity switches which are connected to a common said signal line, arrangement of connection points of said connection wirings of said positive-polarity switches to said positive-polarity video buses in a said sampling circuit block being substantially symmetric with arrangement of connection points of said connection wirings of said negative-polarity switches to said negative-polarity video buses in the same sampling circuit block with respect to a border line between said positive-polarity video buses and said negative-polarity video buses.

According to the invention, imaging defects can be reduced by an improved arrangement of connection points of sampling switches and video bus lines in the signal line drive circuit, in which connection points of a block of video buses supplied with video signals of the positive polarity relative to a predetermined reference potential and a block of video buses supplied with video signals of the negative polarity to their associated analog switches are arranged substantially symmetrically in the extending directions of the video.

More specifically, in the liquid crystal display device according to the invention, since connection points are disposed so that their arrangement of the positive polarity switches and that of the negative polarity switches be symmetric, if a switch of one polarity in a particular pair of switches has a long connection wiring, then the other switch of the other polarity has a short connection wiring. In other words, the sum of connection wirings of a pair of switches and their resistance value are substantially equal to the sum of connection wirings of another pair of switches and their resistance value. As a result, the effective value of the shift amount of the signal line potential is substantially equal in all signal lines, and imaging are alleviated.

According to the second aspect of the present invention, there is provided a liquid crystal display device having:

a display pixel portion including a plurality of pixel capacitors arranged in a matrix on an insulating substrate and a plurality of signal lines each connected commonly to said pixel capacitors in a column; and a signal line drive circuit including positive-polarity video buses for transmitting positive-polarity video signals and negative-polarity video buses for transmitting negative-polarity video signals which are aligned alternately, and sampling circuit blocks made up of a plurality of positive-polarity switches connected individually to different said positive-polarity video buses via connection wirings and a plurality of negative switches connected individually to different said negative-polarity video buses via connection wirings so that both said switches align between said video buses and said display pixel portion so as to make switch pairs each including one of said positive-polarity switches and one of said negative-polarity switches which are connected to a common said signal line, the sum of resistances of connection wirings of said positive-polarity switch and said negative-polarity switch which make a switch pair being substantially constant for all said switch pairs within said sampling circuit block.

According to the third aspect of the present invention, there is provided a liquid crystal display device having same elements as the second aspect except for a relation where the sum of lengths of connection wirings of said positive-polarity switch and said negative-polarity switch which make a switch pair being substantially constant for all said switch pairs within said sampling circuit block.

DESCRIPTION OF THE PREFERRED EMBODIMENTS

Figure 1:
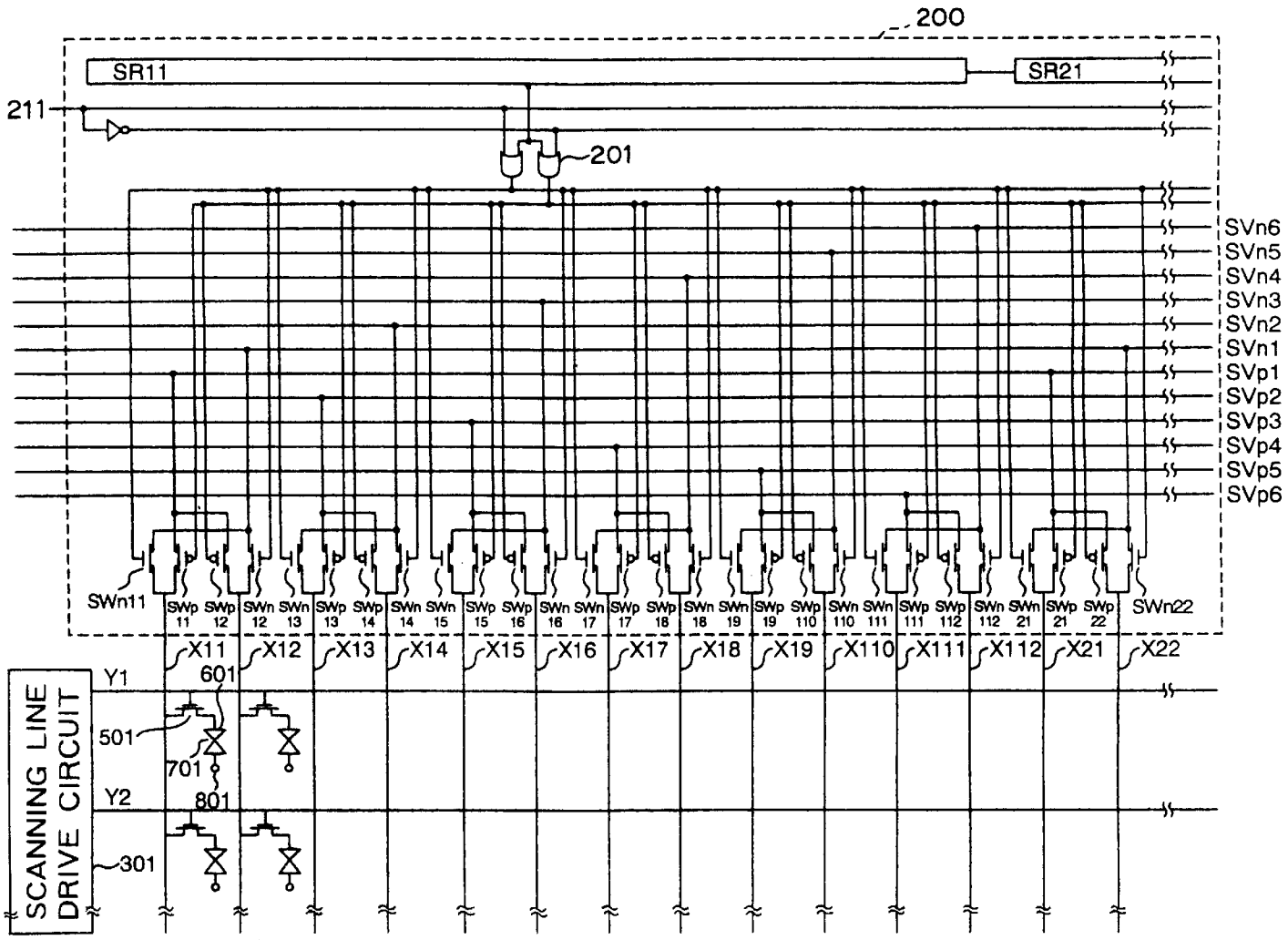
FIG. 1 is a circuit arrangement diagram of a liquid crystal display device according to the first embodiment of the invention.

Explained below are embodiments of the invention in detail with reference to the drawings. In the drawings showing embodiments of the invention, common reference numerals are attached to the same components, and the video signal is supplied in form of six divisional parts.

Some embodiments of the invention are explained below in detail.

FIG. 1 is a circuit arrangement diagram of a liquid crystal display device according to the first embodiment of the invention. Disposed on a glass substrate, not shown, are scanning lines Y1, Y2, . . . and signal lines X11, X12, . . . , 21 and X22, . . . crossing with each other.

Connected to their crossing points are liquid crystal pixel cells 701 via polycrystalline silicon thin-film transistors 501 having MoW gates.

Connected to the scanning lines Y1, Y2, . . . is a scanning line drive circuit 301 to supply selection pulses sequentially so that the thin-film transistors 501 of respective rows sample video signals on the signal lines X11, X12, . . . X21, X22, . . . and output them to the liquid crystal pixels. Transmittance changes in some liquid crystal pixels selected thereby, and an image is displayed accordingly.

The scanning line drive circuit 301 is made up of, for example, a known clocked inverter type shift registers as explained above, and a known flip-flop circuit arrangement may be used. The flip-flop circuits are made up of polycrystalline silicon thin-film transistor circuits made simultaneously with the thin-film transistors 501 for driving pixels in a common process.

Connected to the signal lines X11, X12, . . . , X21, X22, . . . is a signal line drive circuit 200. The basic arrangement of the signal line drive circuit 200 is made of analog switch pairs each including a positive-polarity SWn and a negative-polarity switch SWp connected to each signal line, positive-polarity video buses SVn connected to the positive-polarity switches, negative-polarity video buses SVp connected to the negative-polarity switches, and shift registers SR11, SR12, . . . for controlling sampling actions of the respective analog switches. The suffixed p indicates p channels, and the suffixed n indicates n channels.

The shift registers are made of polycrystalline silicon thin-film transistor circuits which are made simultaneously with the thin-film transistors for driving pixels in a common process like the shift registers of the scanning line drive circuit 301. Also the analog switches and video buses are made of polycrystalline silicon thin-film transistor circuits. That is, the positive-polarity switches SWp are made of p-channel type polycrystalline silicon thin-film transistors whilst the negative-polarity switches SWn are made of n-channel type polycrystalline silicon thin-film transistors.

Among the aligned analog switches, SWn11 through SWn112 and SWp11 to SWp112 make one sampling circuit block, and they are controlled collectively by an output from a common shift register (SR11). In adjacent pairs of switches, a polarity switching circuit 201 controls them so that, when the positive-polarity analog switch effects sampling action in one of the pairs, the negative-polarity analog switch effects sampling action in the other pair.

In the liquid display device according to the embodiment, connection points of the positive-polarity switches SWp with the positive-polarity video buses SVp and connection points of the negative-polarity switches SWn with the negative-polarity video buses SVp are arranged to make symmetric patterns about the border fine of the block of positive-polarity video buses and the block of negative-polarity video buses, namely, about the space between the video buses SVp1 and SVn1. That is, if an analog switch of one polarity is connected to a bus in the video bus block of one polarity remoter from the display region, then the analog switch of the other polarity pairing with the switch is connected to a bus in the video bus block of the other polarity nearer to the display region.

In other words, if the length of the connection wiring of one switch is longer than the average length of connection wirings of the analog switches of the same polarity in the common block, then the length of the connection wiring of the switch of the other polarity is shortened by the same ratio than the average value of the connection wirings of the analog switches of the other polarity in the common block. As a result, the sum of lengths of connection wirings of paired switches is substantially equal in all switch pairs. Since the resistance value of a connection wiring depends on its length, also the total resistance of connection wirings of the switch pair is substantially equal in all switch pairs.

Figure 2:
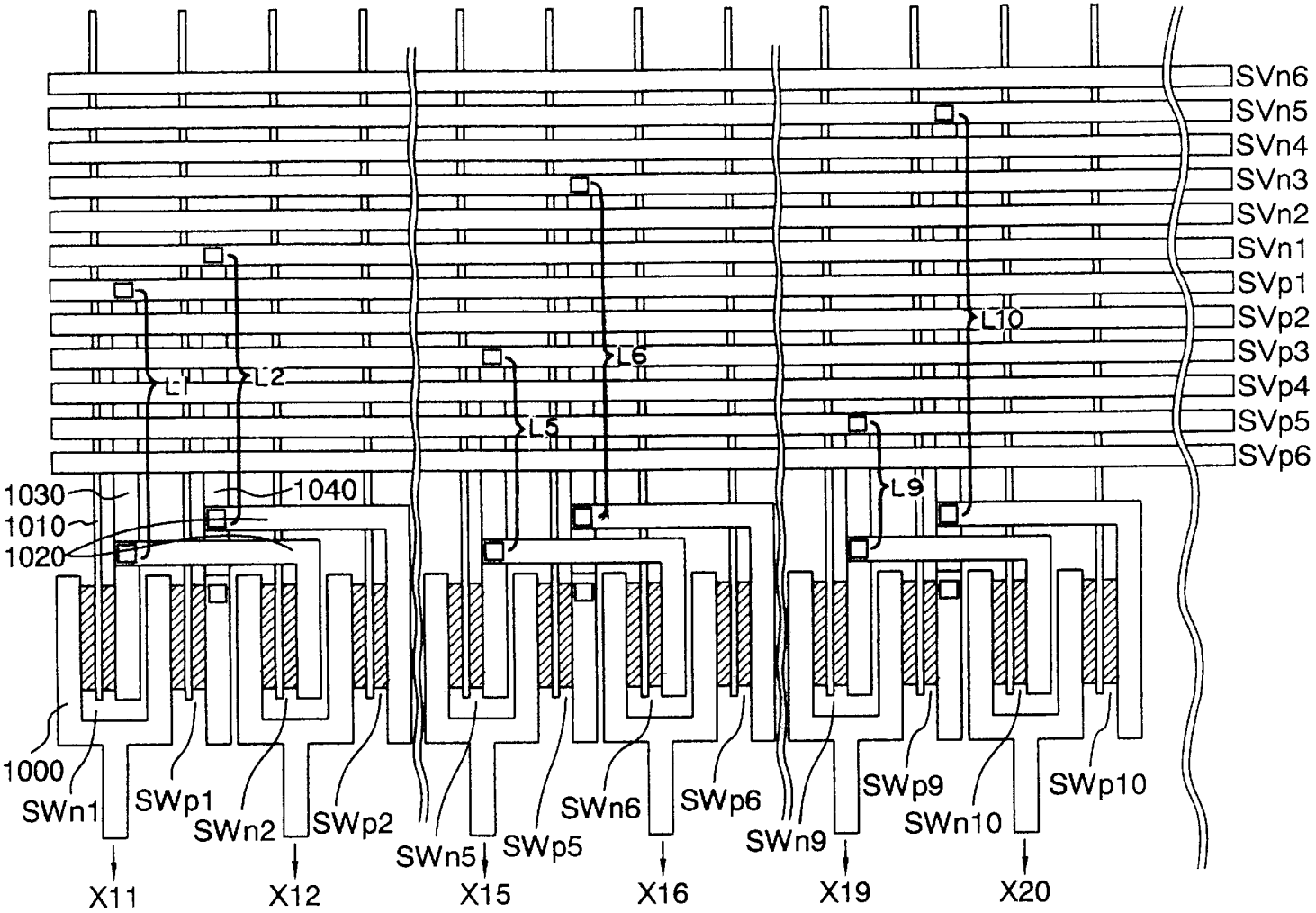
FIG. 2 is a pattern diagram showing an actual pattern in a signal line drive circuit shown in FIG. 1.

FIG. 2 is a pattern diagram showing an actual pattern in the signal line drive circuit shown in FIG. 1. For simplicity, here is shown an arrangement of analog switches for driving signal lines X11, X12, X15, X16, X19 and X20.

Video buses SVp and SVn are made of an aluminum (Al) layer in a common process simultaneously with source electrodes 1000 and drain electrodes 1020 of the polycrystalline silicon thin-film transistors SWp and SWn. Gates 1010 of the analog switches are made of a MoW layer and connected to outputs of the shift registers. The drain electrodes 1020 of the analog switches are connected to video buses by connection wirings 1030 in the common layer via contact holes.

Since connection wirings 1030 are made of a MOW layer common to the layer of the gates of the analog switches, its resistance value is higher than an Al layer, for example. Therefore, during the positive-polarity driven mode, the electric charge accumulated in the switch after the last sampling action flows more into the signal line X20 in the switch SWp10 with a long connection wiring among the positive-polarity switches, whereas the accumulated electric charge flows more into the video bus in the switch SWp1 having a short connection wiring. In contrast, since the switch SWn1 paring with SWp1 has a long connection wiring and the switch SWn10 paring with SWp10 has a short connection wiring, the electric charge accumulated in the analog switch flows more into the signal line X11 during the negative-polarity driven mode oppositely from the positive-polarity driven mode. As a result, in terms of the sum of positive-polarity frames and negative-polarity frames, absolute quantity of electric charges flowing into respective signal lines are flattened.

In the arrangement of FIGS. 1 and 2, when the signal line X11 is remarked, for example, the positive-polarity switch SWp11 samples the video signal on the video bus SVp1 and output it to the signal line X11 in the frame where a positive-polarity voltage is written,. When a negative-polarity voltage is written in the next frame, the negative-polarity switch SWn11 samples the video signal on the video bus SVn1 and output is to the signal line X11.

When the signal line X112 is remarked, the positive-polarity switch SWp112 samples the video signal on the video bus SVp6 and outputs it to the signal line X11 in the frame where a positive-polarity voltage is written. When a negative-polarity voltage is written in the next frame, the negative-polarity switch SWp112 samples the video signal on the video bus SVn6 and output is to the signal line X11.

Lengths of connection wirings shown in FIG. 2 are L1 of the signal line X11, L2 of X12, L5 of X15, L6 of X16, L9 of X19, and L10 of X20, and in respective pairs, the following relations are given.

$$L1+L2=L5+L6=L9+L10=\text{constant}$$

Therefore, although signal lines in the display pixel portion are driven by an alternate current in a predetermined cycle by adjacent pairs of positive-polarity analog switches and negative-polarity switches, effective values of the voltage amount for shifting the signal line potential while the signal line is driven by the positive-polarity analog switch and the voltage amount for shifting the signal line potential while the signal line is driven by the negative-polarity analog switch are substantially flattened, and imaging defects become visually unnoticeable.

Figure 3A:
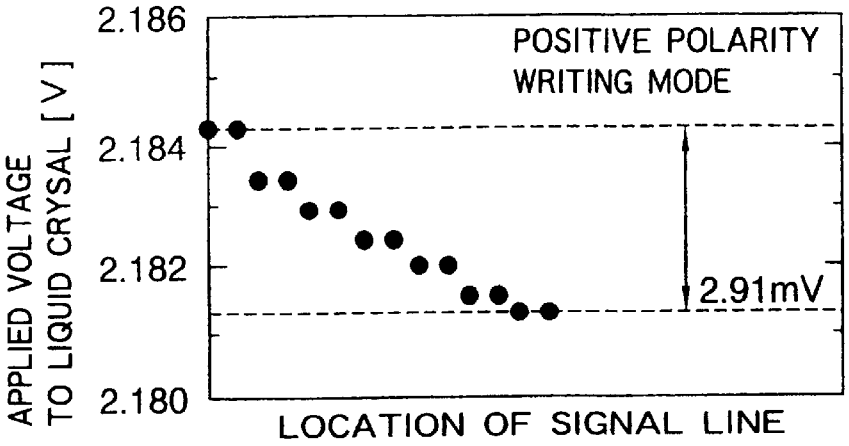
FIGS. 3A through 3C are graphs showing affection of shifting of a signal line potential to an applied voltage to the liquid crystal obtained by simulation to theoretically confirm the effect of the drive circuit arrangement according to the embodiment.
Figure 3B:
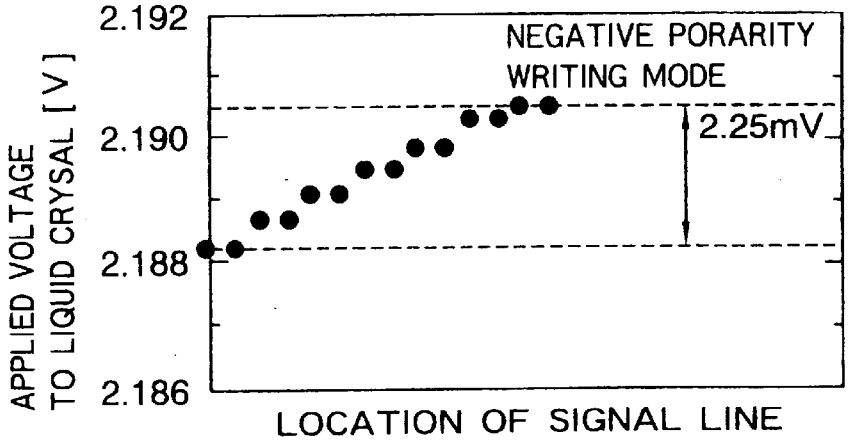
Figure 3C:
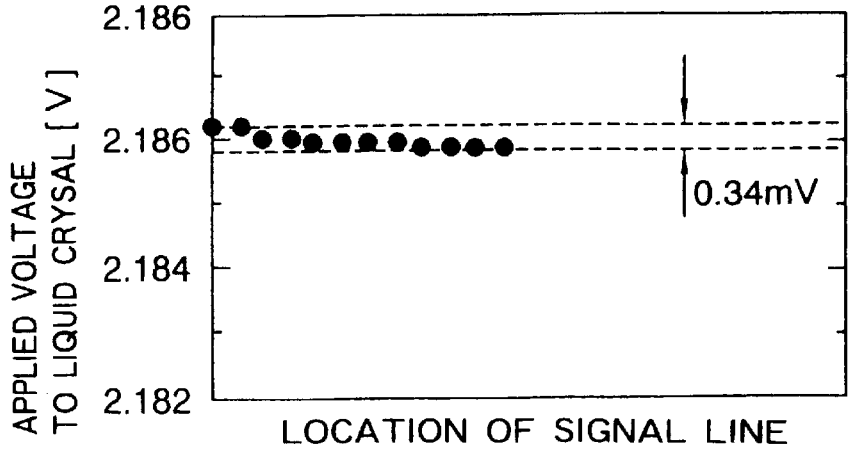

FIGS. 3A through 3C show a result of simulation on influences of potential shift of signal lines to an applied voltage to the liquid crystal for the purpose of theoretically confirming the effect of the drive circuit arrangement according to the embodiment. The applied voltage to the liquid crystal in FIGS. 3A through 3C is an absolute voltage value applied to liquid crystal pixels upon application of a video signal of an intermediate potential between a reference potential maximizing the transmittance of the liquid crystal and the potential minimizing the transmittance.

FIG. 3A shows an aspect of voltage shifting in the positive-polarity writing mode. The applied voltage to the liquid crystal is approximately 2.1841 V in pixels belonging to the signal line X11 connected to SWp11 with the longest connection wiring between the analog switch and the video bus, and it is approximately 2.1813 V in pixels belonging to the signal line X112 connected to SWp112 having the shortest connection wiring. Therefore, the difference in voltage shift amount between pixels belonging to the signal line X11 and pixels belonging to the signal line X112 is approximately 2.91 mV.

FIG. 3B shows the aspect of voltage shifting in the negative-polarity writing mode. The applied voltage to the liquid crystal is approximately 2.188 V in pixels belonging to the signal line X11 connected to SWn11 having the shortest connection wiring between the analog switch and the video bus, and it is approximately 2.193 V in pixels belonging to the signal line X112 connected to SW112 having the shortest connection wiring. Therefore, the difference in voltage shift amount between pixels belonging to the signal line X11 and pixels belonging to the signal line X112 is approximately 2.25 mV.

On the other hands, FIG. 3C shows voltage shift amounts of positive-polarity writing frames and negative-polarity writing frames in frame total. The total voltage shift amounts are average values of the positive-polarity writing mode and tile negative-polarity writing mode, and the maximum difference between different signal lines is 0.34 mV near 2.186 V.

Although differences of 2 to 3 mV in shift amount exist between different signal lines, these differences are averaged in terms of positive- and negative-polarity frame total, and can be remarkably decreased as small as 0.34 mV in maximum.

In this manner, the effect of the drive circuit arrangement according to the embodiment can be confirmed theoretically. Moreover, a liquid crystal display device having the circuit arrangement according to the embodiment of the invention was actually made and operated to display images, no imaging defect was visually noticeable, and a good imaging quality was realized.

For comparison purposes, another liquid crystal display device using the same arrangement of connection points to video buses between positive-polarity switches and negative-polarity switches (when a positive-polarity switch is connected to a positive-video bus nearest to the display pixel portion, also the negative-polarity switch pairing with the positive-polarity switch is connected to a negative-polarity video bus nearest to the display pixel portion) was actually operated to display images, stripe-shaped imaging defects were visually noticeable. It was caused probably by the fact that differences in shift amount between different signal lines were not averaged even in the positive- and negative-polarity frame total, differences in shift amount were as large as 2 to 3 mV in maximum, and the differences in voltage appeared as differences in transmittance on the display screen.

In this manner, the fluid crystal display device according to the embodiment certainly realized a good imaging quality without visually noticeable imaging defects.

Figure 4:
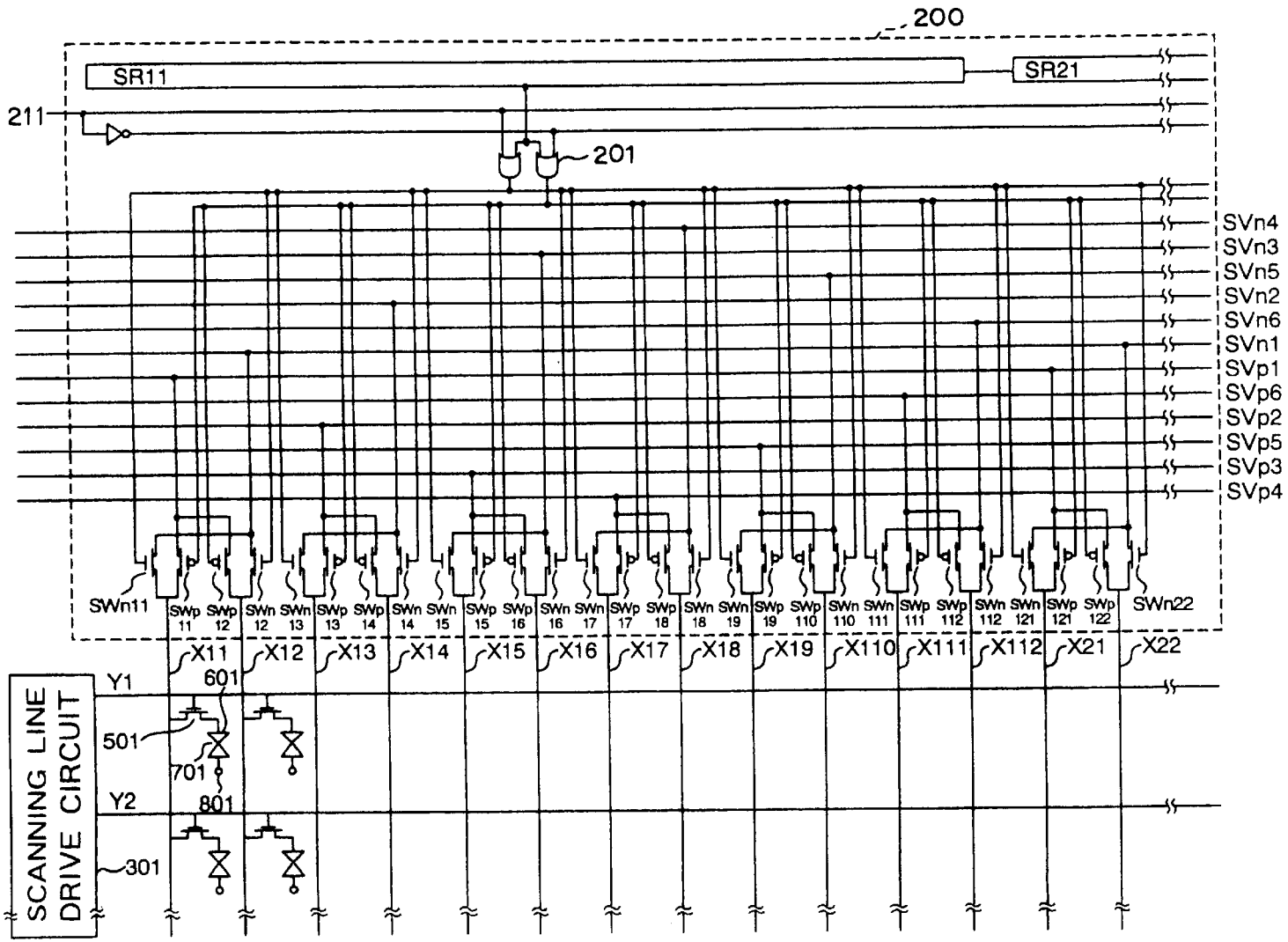
FIG. 4 is a circuit arrangement diagram of a liquid crystal display device according to the second embodiment of the invention.

FIG. 4 shows a circuit arrangement of a liquid crystal display device according to the second embodiment of the invention. This is different from the foregoing first embodiment in that connection points of analog switches to video buses are arranged to be symmetric in each single sampling circuit block about its center.

In this arrangement, since lengths of connection wiring (resistances of connection wirings) are substantially equal between different analog switches located near the boundary between adjacent sampling circuit blocks, the transmittance does not change or is small even at boundaries between adjacent blocks, and the imaging quality is further improved to visually remove noticeable boundaries.

Figure 5:
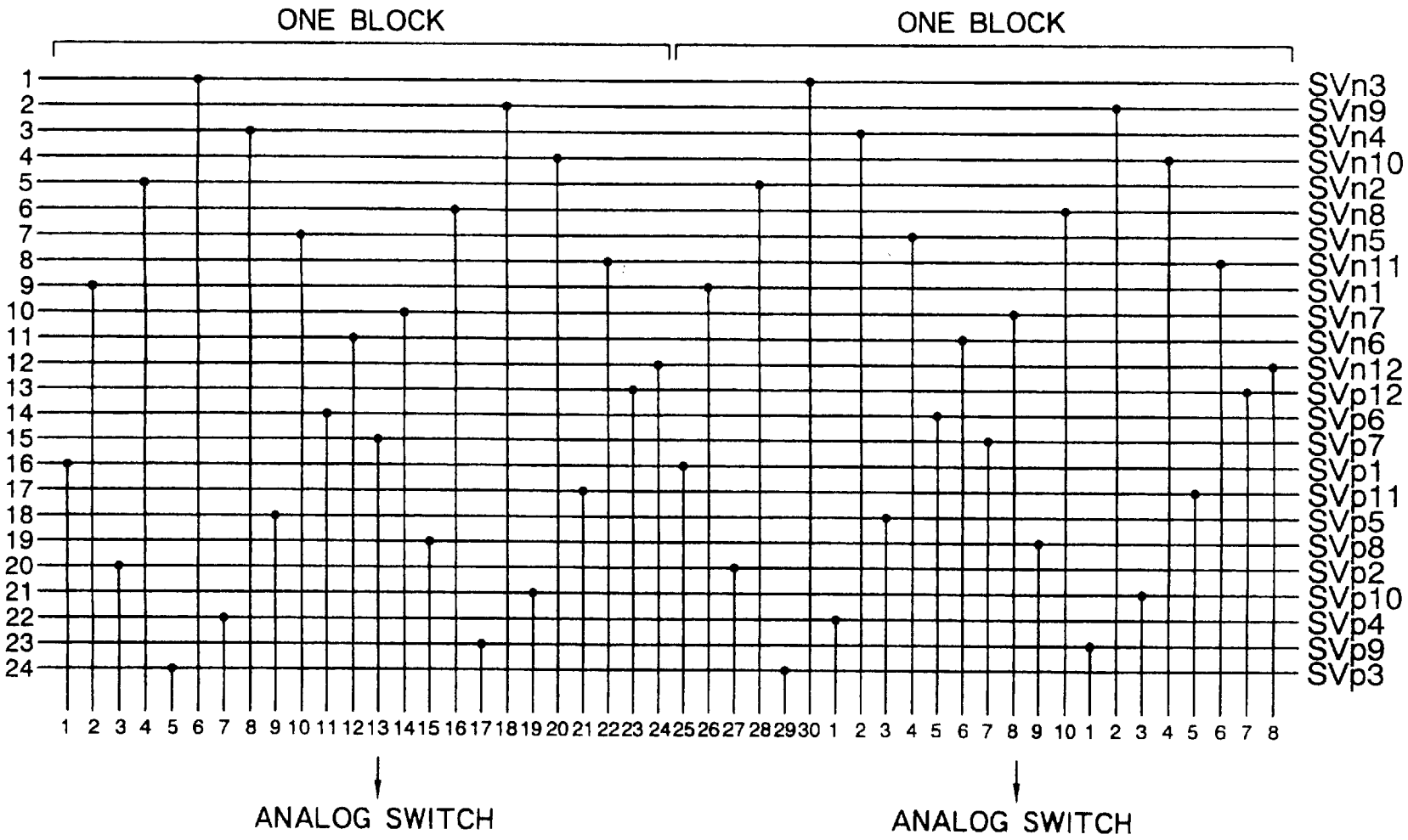
FIG. 5 is a explanatory diagram showing a wiring pattern in a liquid crystal display device according to the third embodiment of the invention.
Figure 6:
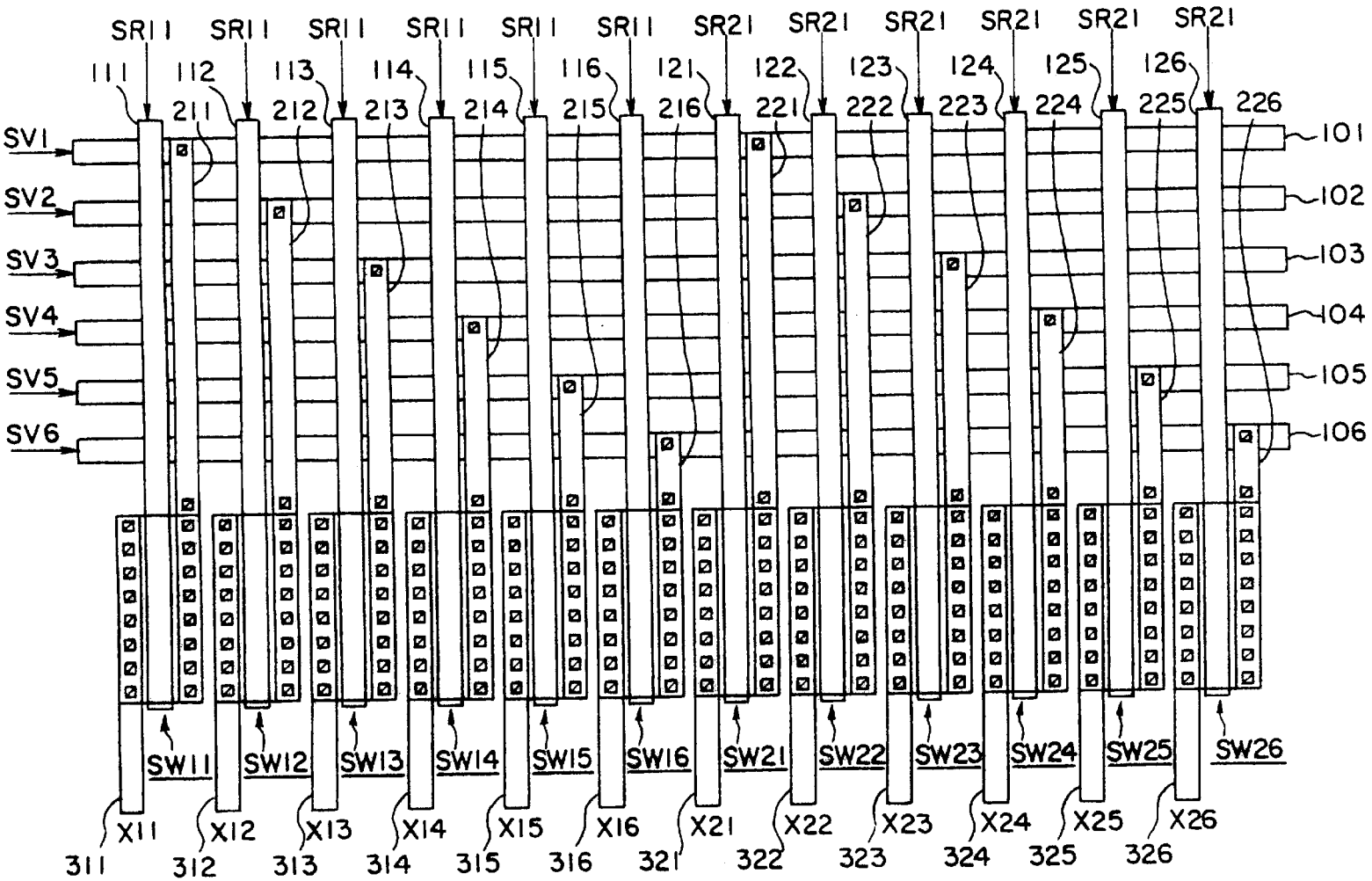
FIG. 6 PRIOR ART
FIG. 6 is an explanatory diagram showing a wiring pattern in a signal line drive circuit made by a conventional approach.
Figure 7:
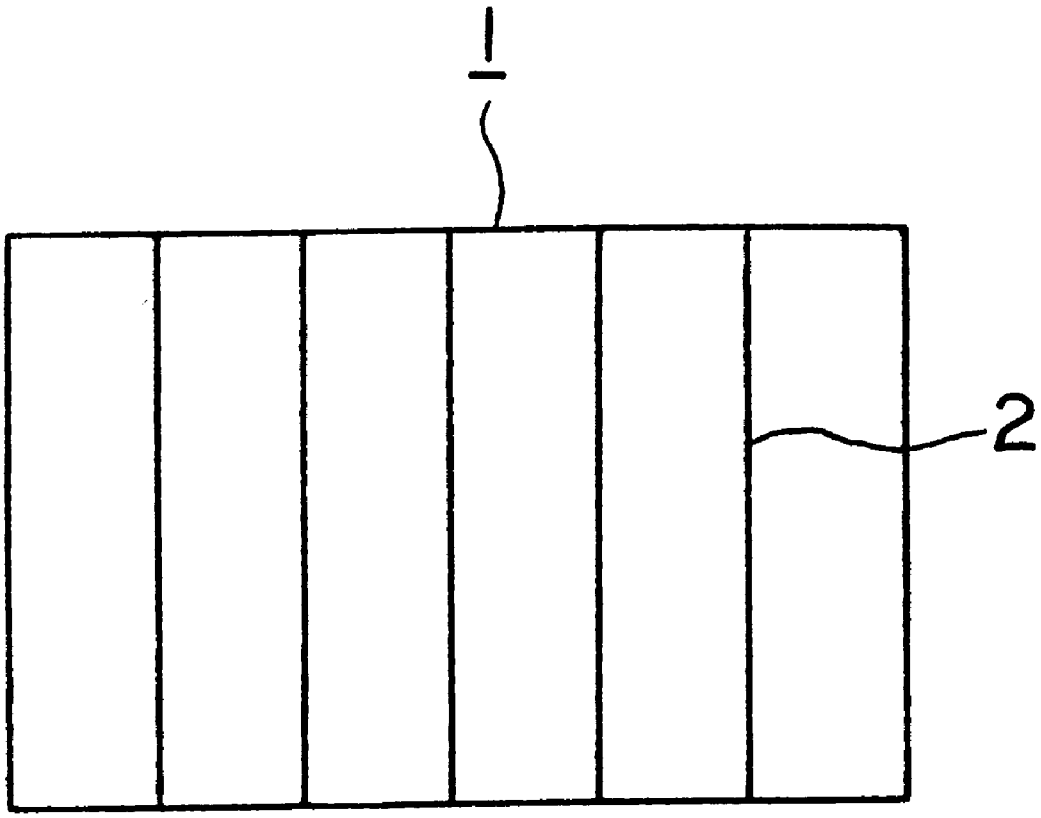
FIG. 7 PRIOR ART
FIG. 7 is an explanatory diagram showing a wiring pattern in a signal line drive circuit made by a conventional approach.

FIG. 5 is a circuit arrangement diagram of a liquid crystal display device according to the third embodiment of the invention. In this embodiment, connection points make a shorter cyclic arrangement. In the structure shown here, connection points are disposed to exhibit an arrangement which is repeated in a half cycle of one block and to equalize the pattern of arrangement between two adjacent blocks.

The circuit arrangement used in the invention can be modified within the scope of the invention.

For example, the pattern of arrangement of connection points of positive-polarity buses to connection wirings and the pattern of arrangement of connection points of negative-polarity buses to connection wirings need not be fully symmetric. For example, one of the patterns may be the pattern of the other moved in parallel along the extending direction of the buses. Additionally, the sum of resistances of different connection wirings need not be completely equal in all switch pairs, and it is sufficient that connection points are disposed to compensate a deviation of the length of or resistance value of a connection wiring of a switch of one polarity from the average value (average value of lengths or resistance values of connection wirings of switches with a common polarity within a block) with a deviation of from the average value of lengths or resistance values of connection wirings of switches making pairs with those switches.

As described above, the liquid crystal display device according to the invention realizes a good imaging quality suppressing imaging defects by improving the arrangement of connection points between sampling switches and video bus lines within the signal line drive circuit to locate the connection points such that connection points of video buses supplied with positive video signals relative to a predetermined reference voltage to analog switches make a pattern substantially symmetric from a pattern made by connection points of video buses supplied with negative video signals with analog switches in the extending direction of the video buses.

Moreover, the invention realizes a good imaging quality suppressing imaging defects even when maintaining substantially constant the sum of resistances of connection wirings of the positive-polarity switch and the negative-polarity switch in any switch pair in a sampling circuit block, or when maintaining the sum of lengths of the connection wirings constant.

What is claimed is:

1. A liquid crystal display device comprising:

a display pixel portion including a plurality of pixel capacitors arranged in a matrix on an insulating substrate and a plurality of signal lines each connected commonly to said pixel capacitors in a column; and a signal line drive circuit including 3 or more positive-polarity video buses for transmitting positive-polarity video signals and 3 or more negative-polarity video buses for transmitting negative-polarity video signals which are aligned alternately, and sampling circuit blocks made up of a plurality of positive-polarity switches connected individually to different said positive-polarity video buses via connection wirings and a plurality of negative switches connected individually to different said negative-polarity video buses via connection wirings so that both said switches align between said video buses and said display pixel portion so as to make switch pairs each including one of said positive-polarity switches and one of said negative-polarity switches which are connected to a common signal line, wherein said group of the 3 or more positive-polarity video buses and said group of the 3 or more of negative-polarity video buses is constructed and arranged so as to be separated by a border, and wherein the sum or resistances of connection wirings connecting said positive-polarity switch and said negative-polarity switch which make a switch pair to corresponding said positive polarity video buses and said negative-polarity video buses is substantially constant.

2. The liquid crystal device according to claim 1, wherein said signal line drive circuit is formed on said insulating substrate.

3. The liquid crystal display device according to claim 4 wherein said insulating substrate is a glass substrate.

4. The liquid crystal display device according to claim 1, wherein capacitance of said pixel cells is connected to said signal lines via selection switches controlled in switching action by scanning lines made on said insulation substrate to cross with said signal.

5. The liquid crystal display device according to claim 4 wherein said positive-polarity switches, said negative-polarity switches and said selection switches are made of thin-film transistors.

6. The liquid crystal display device according to claim 5 wherein said thin-film transistors are polycrystalline silicon thin-film transistors.

7. The liquid crystal display device according to claim 5 wherein said positive-polarity switches are made of p-channel type thin-film transistors, and said negative-polarity switches are made of n-channel type thin-film transistors.

8. The liquid crystal display device according to claim 1 wherein an arrangement of connection points of said connection wirings of said positive-polarity switches to said positive-polarity video buses in any one of said sampling circuit blocks is substantially symmetric with an arrangement of connection points of said connection wirings of said negative-polarity switches to said negative-polarity video buses in the same sampling circuit block with respect to a border line between said positive-polarity video buses and said negative-polarity video buses.

9. The liquid crystal display device according to claim 8 wherein the arrangement of said connection points of said connection wirings of said positive-polarity switches to said positive-polarity video buses in a particular one of said sampling circuit blocks exhibits substantially the same configuration as the arrangement of said connection points of said connection wirings of said negative-polarity switches to said negative-polarity video buses in a said sampling circuit block adjacent to said particular sampling circuit block.

10. The liquid crystal display device according to claim 9, wherein the arrangement of said connection points of said connection wirings of said positive-polarity switches to said positive-polarity video buses is substantially symmetric with the arrangement of said connection points of said connection wirings of said negative-polarity switches to said negative-polarity video buses with respect to the center of said sampling circuit block.

11. A liquid crystal display device comprising:

a display pixel portion including a plurality of pixel capacitors arranged in a matrix on an insulating substrate and a plurality of signal lines each connected commonly to said pixel capacitors in a column; and a signal line drive circuit including 3 or more positive-polarity video buses for transmitting positive-polarity video signals and 3 or more negative-polarity video buses for transmitting negative-polarity video signals which are aligned alternately, and sampling circuit blocks made up of a plurality of positive-polarity switches connected individually to different said positive-polarity video buses via connection wiring and a plurality of negative switches connected individually to different said negative-polarity video buses via connection wirings so that both said switches align between said video buses and said display pixel portion so as to make switch pairs each including one of said positive-polarity switches and one of said negative-polarity switches which are connected to a common signal line, wherein said group of the 3 or more positive-polarity video buses and said group of the 3 or more negative-polarity video buses is constructed and arranged so as to be separated by a border, and wherein the sum of lengths of connection wiring of said positive-polarity switch and said negative-polarity switch which make a switch pair to corresponding said positive polarity video buses and said negative-polarity video buses is substantially constant.

12. The liquid crystal display device according to claim 11, wherein an arrangement of connection points of said connection wirings of said positive-polarity switches to said positive-polarity video buses in any one of said sampling circuit blocks is substantially symmetric with arrangement of connection points of said connection wirings of said negative-polarity switches to said negative-polarity video buses in the same sampling circuit block with respect to a border line between said positive-polarity video buses and said negative-polarity video buses.

13. The liquid crystal display device according to claim 12, wherein the arrangement of said connection points of said connection wirings of said positive-polarity switches to said positive-polarity video buses in a particular one of said sampling circuit blocks exhibits substantially the same configuration as the arrangement of said connection points of said connection wirings of said negative-polarity switches to said negative-polarity video buses in a said sampling circuit block adjacent to said particular sampling circuit block.

14. The liquid crystal display device according to claim 13, wherein the arrangement of said connection points of said connection wirings of said positive-polarity switches to said positive-polarity video buses is substantially symmetric with the arrangement of said connection points of said connection wirings of said negative-polarity switches to said negative-polarity video buses with respect to the center of said sampling circuit block.

15. The liquid crystal display device according to claim 11 wherein said signal line drive circuit is formed on said insulating substrate.

16. The liquid crystal display device according to claim 15 wherein said insulating substrate is a glass substrate.

17. The liquid crystal display device according to claim 11 wherein capacitance of said pixel cells is connected to said signal lines via selection switches controlled in switching action by scanning lines made on said insulating substrate to cross with said signal.

18. The liquid crystal display device according to claim 17 wherein said positive-polarity switches, said negative-polarity switches and said selection switches are made of thin-film transistors.

19. The liquid crystal display device according to claim 18, wherein said thin-film transistors are polycrystalline silicon thin-film transistors.

20. The liquid crystal display device according to claim 18 wherein said positive-polarity switches are made of p-channel type thin-film transistors, and said negative-polarity switches are made of n-channel type thin-film transistors.

* * * * *